US007881499B2

(12) United States Patent
Bissonnette et al.

(10) Patent No.: US 7,881,499 B2
(45) Date of Patent: Feb. 1, 2011

(54) GOLF CLUB AND BALL PERFORMANCE MONITOR WITH AUTOMATIC PATTERN RECOGNITION

(75) Inventors: Laurent C. Bissonnette, Portsmouth, RI (US); Diane I. Pelletier, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 1400 days.

(21) Appl. No.: 10/667,478

(22) Filed: Sep. 23, 2003

(65) Prior Publication Data

US 2005/0063595 A1 Mar. 24, 2005

(51) Int. Cl.
*G06K 9/00* (2006.01)

(52) U.S. Cl. ..... 382/106; 382/107

(58) Field of Classification Search ..... 382/106, 382/107; 343/131, 145, 146, 147, 148, 174, 343/198, 282, 285, 406, 407
See application file for complete search history.

(56) References Cited

U.S. PATENT DOCUMENTS

| | | | | |
|---|---|---|---|---|
| 4,136,687 | A | 1/1979 | Dabroski | |
| 4,137,566 | A | 1/1979 | Haas et al. | |
| 4,158,853 | A | 6/1979 | Sullivan et al. | |
| 5,413,345 | A * | 5/1995 | Nauck | 473/156 |
| 5,471,383 | A | 11/1995 | Gobush et al. | |
| 5,501,463 | A | 3/1996 | Gobush et al. | |
| 5,575,719 | A | 11/1996 | Gobush et al. | |
| 5,803,823 | A | 9/1998 | Gobush et al. | |
| 6,042,483 | A | 3/2000 | Katayama | |
| 6,241,622 | B1 | 6/2001 | Gobush et al. | |
| 6,285,445 | B1 | 9/2001 | Winfield et al. | |
| 6,286,364 | B1 | 9/2001 | Aoyama et al. | |
| 6,390,934 | B1 | 5/2002 | Winfield et al. | |
| 6,431,990 | B1 | 8/2002 | Manwaring | |
| 6,458,035 | B1 | 10/2002 | Katayama | |
| 6,488,591 | B1 | 12/2002 | Gobush et al. | |
| 6,500,073 | B1 | 12/2002 | Gobush et al. | |
| 6,506,124 | B1 | 1/2003 | Manwaring et al. | |
| 6,519,545 | B1 * | 2/2003 | Amano | 702/127 |
| 6,533,674 | B1 | 3/2003 | Gobush | |
| 6,561,917 | B2 | 5/2003 | Manwaring | |
| 6,579,190 | B2 * | 6/2003 | Yamamoto | 473/141 |
| 6,974,395 | B1 * | 12/2005 | Rioux et al. | 473/409 |
| 7,184,569 | B2 * | 2/2007 | Lawandy et al. | 382/100 |
| 2001/0029207 | A1 * | 10/2001 | Cameron et al. | 473/151 |
| 2002/0038294 | A1 * | 3/2002 | Matsugu | 706/20 |
| 2002/0082123 | A1 * | 6/2002 | Vochezer | 473/408 |
| 2004/0032970 | A1 * | 2/2004 | Kiraly | 382/103 |

* cited by examiner

*Primary Examiner*—Brian Q Le
(74) *Attorney, Agent, or Firm*—Hanify & King, P.C.

(57) ABSTRACT

A method for automatically identifying an object is disclosed. Preferably, the method is used in conjunction with a performance monitor. A set of markers are selectively positioned on the surface of each of a plurality of golf clubs and golf balls. It is desired that each set of markers for a unique pattern on each of the golf clubs and golf balls. Each unique pattern is preferably acquired and stored. A player may choose any of a plurality of golf clubs and golf balls. When within the field of view of the performance monitor, the pattern on the club and ball is automatically matched with the stored patterns, thereby identifying the type of club and ball.

21 Claims, 1 Drawing Sheet

GOLF CLUB AND BALL PERFORMANCE MONITOR WITH AUTOMATIC PATTERN RECOGNITION

FIELD OF THE INVENTION

The present invention relates to a golf club and ball performance monitor. More specifically, the present invention relates to an optical pattern recognition device that automatically identifies equipment.

BACKGROUND OF THE INVENTION

Golf equipment manufacturers currently spend a large amount of time and money on research and development related to better golf clubs and golf balls. Their innovation has led to the development of golf clubs and balls with a wide range of performance characteristics to account for many different types of golfers. Golf clubs may have varying shaft lengths or stiffness. Golf clubs may be manipulated to have different head characteristics, such as loft or lie angle. They may even be manufactured with various combinations of materials in order to attain a specific coefficient of restitution (COR).

Similarly, golf balls have been developed and researched in a similar manner. Golf balls may have solid cores, semi-solid cores, or even fluid cores. They may be manufactured using injection molding processes or they may use a winding process. Even the covers have been manipulated to have a desired number of dimples or dimple arrangements, which aid in increasing or decreasing the lift and drag coefficients of the ball.

The innovations and efforts expended to produce optimal golf equipment, with specifications that meet the requirements set by professional golf associations, are aimed at providing golfers with the best chances of success. However, once a club and ball leave a manufacturer, the performance of the equipment depends largely on the technique and skill of an individual player. Thus, even the most advanced equipment may not be able to correct or fully compensate for flaws in a player's swing.

Many methods and devices have been developed in order to assist players in obtaining an optimal swing. These methods typically consist of acquiring images of a player swinging a golf club and making contact with a golf ball. In a most rudimentary system, photographs of a player's swing, possibly from different angles, may assist a player in correcting their swing. In more advanced systems, a club and ball may be tagged using a set of markers. In combination with a camera system, this can be a powerful tool for analyzing the swing of a player. Typically, the markers placed on the equipment are selected to create a high contrast on the images of the swing captured by the camera. In one example, the markers may be black dots on the surface of a white ball. A strobe fired at the ball during impact captures the black dots on a high contrast white background. The use of black dots, however, may not generate sufficient contrast to allow such a system to be used in an outdoor environment.

As a result, there have been improvements in the types of markers used in more advanced systems that can generate a higher contrast image than is possible with black dots. Two examples of markers in this category are retroreflective markers and fluorescent markers. Retroreflective markers may be manufactured using a variety of materials. These markers may then be placed onto golf equipment. Retroreflective markers are typically used because they return more light to a source than a white diffuse surface. This is because retroreflective markers are designed to reflect a large percentage of concentrated light as a narrow beam back to light source. This is in contrast to a white diffuse surface that reflects light in all directions. Examples of the use of retroreflective markers in monitoring a player's golf swing may be found in U.S. Pat. Nos. 4,158,853, 6,488,591 B1, and 5,471,383, the entireties of which are incorporated herein by reference thereto.

Fluorescent markers are also employed to analyze a player's golf swing. Fluorescent markers may also be manufactured using a variety of materials. However, in contrast to other types of markers, fluorescent markers only reflect light within a range of a desired wavelength. Therefore, when light hits a fluorescent marker, a portion of the spectrum of the light will excite the fluorescent marker to only return light within a certain wavelength range. Examples of these types of markers, in combination with camera systems and filters, are described in U.S. Patent Application No. 2002/0173367, the entirety of which is incorporated herein by reference thereto.

Typically, prior camera systems utilized only one type of marker for the objects being monitored. In other words, prior systems typically did not combine different markers. When multiple types of markers have been used, the monitoring systems essentially used two separate camera systems to capture images of the different markers. U.S. Patent Application No. 20002/0155896, for instance, uses two sets of two cameras to capture images of the club and images of the ball. Thus, the monitoring resulted in a complex event scene.

There have been other improvements to swing analysis systems. For instance, prior camera systems that acquire images typically encounter problems with noise and unwanted artifacts. Newer digital cameras typically employ a shutter and a CCD, among other components, to acquire an image. The CCD may be selectively activated and deactivated to acquire an image. This typically reduces the noise and artifacts that are included in an image. However, in many imaging systems that are used to acquire images of a player's swing and/or contact with a golf ball, ambient light can distort the image or captured images and reduce the accuracy and prevents an accurate analysis of a players swing.

Despite these improvements, most swing analysis systems require an operator to manually enter the type of club and ball that are being used. This must be repeated every time a player chooses a different type of club or ball, resulting in significant downtime. Because the club and ball type are necessary for proper analysis, it is important that this information is entered correctly. No matter how advanced the system, when an operator incorrectly enters information, improper analysis will result.

A continuing need exists for a method for automatically determining the type of golf club and golf ball being used with a swing analysis system.

SUMMARY OF THE INVENTION

The present invention comprises a method for optical pattern recognition. In a preferred embodiment, the present invention may be adapted to work with any device that measures the kinematics of a golf club and/or golf ball. These devices are typically referred to as performance monitors. According to the present invention, reference images, or other image reference data such as spatial coordinates, of a plurality of objects are acquired and stored in a memory. The image reference information may include, but is not limited to, spatial information, reference images, color information, moment, Eigen values, or any other mathematical comparison technique. When a performance monitor is in use, the present invention uses a computational system to compare the images acquired of a moving object, with the stored image reference information. A matching pattern may then be determined, thereby automatically identifying the moving equipment.

In one preferred embodiment, the present invention comprises a method for automatically identifying a plurality of golf clubs and golf balls. The method includes storing image reference information for each of the plurality of golf clubs and golf balls. When a player swings a club and impacts a ball, the present invention then automatically identifies the club and ball based on a comparison to the stored image reference information. In a preferred embodiment, the club and ball may be automatically identified within about six seconds or less. In a most preferred embodiment, they may be automatically identified within about one second or less.

In a preferred embodiment, the image reference information is based on a plurality of markers. In one preferred embodiment, the markers comprise visible ink. In some embodiments, the visible ink markers comprise limited spectrum markers that are responsive to colored light. In other embodiments, the limited spectrum markers are responsive to fluorescent light. In another preferred embodiment, the markers may comprise ink that is responsive to ultraviolet light.

In some embodiments, the image reference information does not have to be based on a plurality of markers. The present invention is capable of storing image reference information based on inherent features of the clubs and balls. This embodiment may use a mathematical algorithm, such as Eigen values, to distinguish between the inherent features of a plurality of clubs and balls. Obtaining image reference information using inherent features of the clubs and balls may be desirable to prevent markers from interfering with the trajectory of the ball.

In another preferred embodiment, the present invention comprises a system for automatically identifying a plurality of objects. The system comprises at least one camera system and a computational device capable of identifying an acquired image from a library of stored reference information.

In a preferred embodiment, the system identifies the acquired image based on the inherent features of the clubs and balls. The system may use a mathematical algorithm, such as Eigen values, to distinguish between the inherent features of a plurality of clubs and balls. In another preferred embodiment, the system can distinguish between the plurality of clubs and balls based on a plurality of ultraviolet or visible markers. The preferred embodiment is capable of storing about 200 or more objects in its library of stored reference information.

The present invention, as discussed in the embodiments described above, allows equipment such as a golf ball or golf club to be identified rapidly, preferably within about one second or less. This represents a significant improvement over prior art methods, which often required manual entry of the equipment being used or took several minutes to identify a club or ball. These delays presented a disadvantage of requiring the golfer to wait for entry of information for the analysis to be completed long after the ball has been struck. By automatically identifying the equipment that is being used in the manner described herein, the present invention significantly reduces the chances of human error interfering with the equipment identification, and expedites the player testing process.

DETAILED DESCRIPTION OF THE PREFERRED EMBODIMENTS

Figure 1:
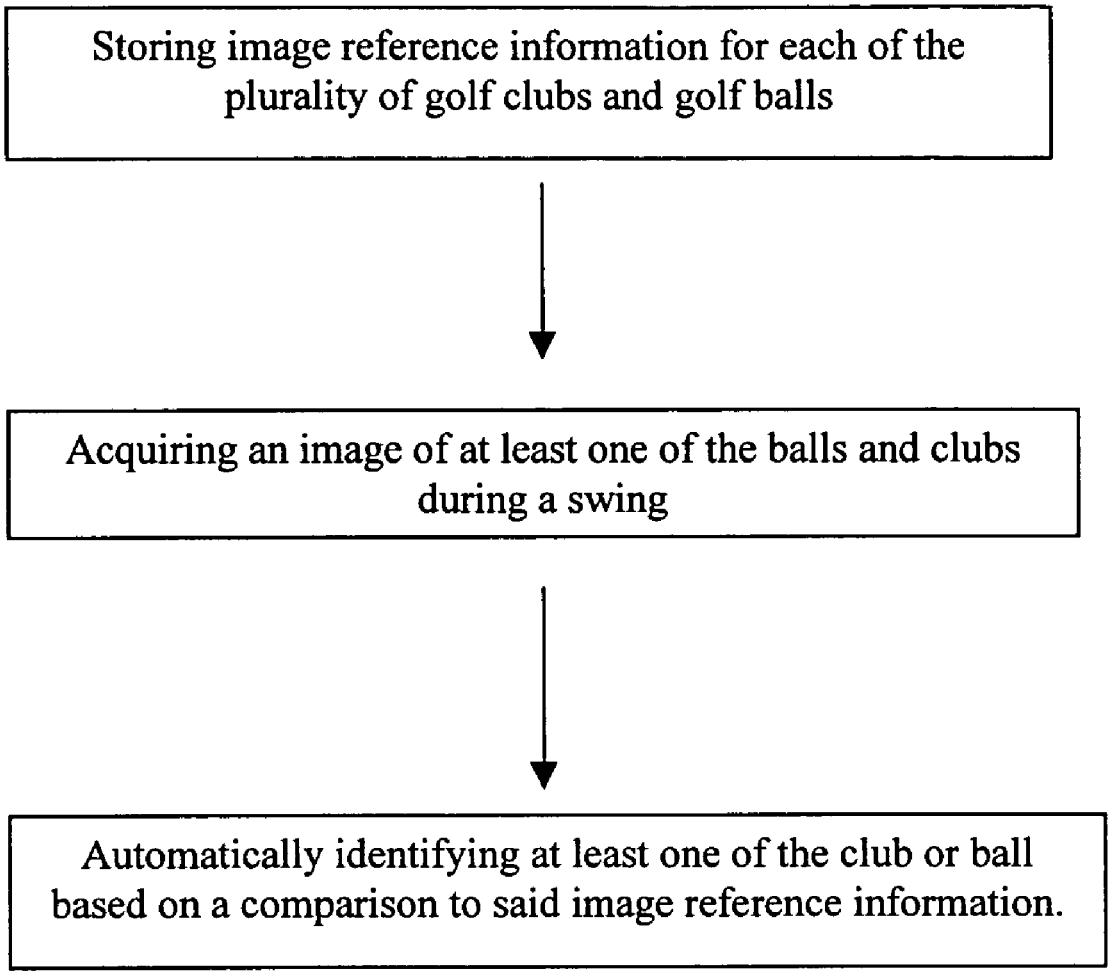
FIG. 1 is a flow chart showing steps in a preferred embodiment of the present invention.

Referring to FIGURE 1, the present invention comprises a method for optical pattern recognition. In a preferred embodiment, the present invention may be adapted to work with any device that measures the kinematics of a golf club and/or golf ball. These devices are typically referred to as performance monitors. According to the present invention, reference images, or other image reference data such as spatial coordinates, of a plurality of objects are acquired and stored in a memory. The image reference information may include, but is not limited to, spatial information, reference images, color information, moment, Eigen values, or any other mathematical comparison technique. When a performance monitor is in use, the present invention uses a computational system to compare the images acquired of a moving object, with the stored image reference information. A matching pattern may then be determined, thereby automatically identifying the moving equipment.

A preferred embodiment of the present invention may be adapted to work with any known performance monitor. Typically, performance monitors utilize one or more camera systems to obtain image information pertaining to objects, such as golf clubs or balls, as they pass through an imaging systems field of view. The obtained information may be used for a variety of applications, including computing the kinematics of the objects.

Each golf player may have a different swing, which can vary because of a player's swing speed, technique, grip, or the like. Depending on the characteristics of a player's swing, a golf club and ball may be chosen that give a player the best chance to succeed. To determine this, golf player's use performance monitors to analyze their swing, and its result on the trajectory of a golf ball. By analyzing a player's swing with a plurality of different golf clubs, a performance monitor can help a player determine which club is ideal for their playing style. Similarly, by analyzing the effect of the swing on the trajectory of a plurality of golf balls, a player can determine which type of ball suits their playing style.

A given player may analyze his or her swing with a plurality of golf clubs and golf balls. In order to properly analyze and store a player's information, the type of golf club and golf ball that is used must be stored along with the kinematic analysis of the club and ball. Prior art performance monitors have relied on the operator of a performance monitor to input this information. However, manually inputting the club and ball type is subject to human error, and may be time consuming.

The present invention provides a method for storing information about each of a plurality of golf clubs and golf balls. This information includes, but is not limited to, the manufacturer, head model, shaft model, shaft stiffness, head loft, club type, shaft length, grip model, ball model, or the like. When a player has their swing analyzed by a performance monitor, information about the club and ball, along with an analysis of the swing as well as club and ball kinematics, is automatically obtained and stored in a memory. This may be repeated using a plurality of balls and clubs. The collected information may be analyzed by a computing device to determine which golf club and golf ball is ideal for a given player.

In a preferred embodiment, the present invention allows the performance monitor to automatically identify the object or objects that pass through the imaging field of view. This is preferably accomplished by comparing the moving objects to a library of reference objects.

Preferably, the present invention is operatively connected to a performance monitor in order to help a player determine which equipment allows them to maximize their performance. By automatically identifying the type of club and ball, the present invention solves the problem of improper data entry and expedites the player testing process.

Any type of object may be used in accordance with the present invention. In a preferred embodiment, any type of golf club or golf ball may be used. Any number of clubs or balls may be used. Preferably, the stored object reference library has 100 or more objects. More preferably, the reference library has 200 or more objects, and most preferably the total number of stored objects is 600 or more. Any type of golf club including, but not limited to, a wedge, driver, putter, or the like, may be used. Any ball, with any hardness, number of dimples, spin, or the like may also be used.

Preferably, at least one set of markers is placed on the surface of the golf club and golf ball. One set of markers may respond to a limited spectrum of light, while the other set can respond to an alternative spectrum of light. One example of a marker arrangement that may be used in accordance with the present invention is described in co-pending U.S. patent application Ser. No. 10/656,882, which is incorporated herein in its entirety. Either set of markers may be placed on the club or the ball. More than two sets of markers may be used. In one example, two or more sets of limited spectrum markers may be used.

One example of the present invention is the use of ink based markers. In one embodiment, ink based markers may be pad printable. In other words, a pad printing process, many of which are well known to those skilled in the art, may be used to apply the markers to an object. In one embodiment, the ink may be responsive to fluorescent light. In an alternate embodiment the ink is responsive to ultraviolet (UV) light. These UV markers are invisible under normal light, but can be captured by an imaging system that uses UV light.

In a preferred embodiment, a plurality of markers may be placed at different points on the surface of the golf club. The different points may include the shaft, toe, heel, or sole of the club. In many performance monitors, the placement of the markers is chosen in order to identify from the images the orientation, clubhead speed, and possibly other characteristics of the swing of the club. The placement of the markers also may be selected in order to measure kinematic characteristics of the club such as loft or lie angle and rotation rate of the club during the swing. Those skilled in the art will recognize that the placement of the markers may be varied according to a particular application.

The placement of the fluorescent markers on the surface of the golf ball likewise may be placed in a manner that allows the camera system to identify the ball and its orientation. Similar to the placement of the markers on the surface of the golf club, the placement of the markers on the surface of the golf ball is chosen in order to identify ball flight characteristics from the captured images. Skilled artisans would recognize that many different marker sizes, configurations, orientation, and position may be used on a ball to measure flight characteristics such as spin, trajectory, and velocity. Some examples of marker placement for a golf ball are described in U.S. Pat. No. 6,390,934, which is incorporated herein in its entirety. In another preferred embodiment, no markers are placed on the objects. In such an embodiment, the imaging system uses inherent object features for pattern recognition. Using the inherent features of the object enables the present invention to distinguish between each of a plurality of objects. Similar methods have been used in face recognition systems that distinguish between each of a plurality of faces.

It is desired that the placement of the markers on the surface of each golf club or ball be unique. In other words, the pattern formed by the placement of the markers on the surface of any two clubs or any two balls should not be the same. Preferably, the present invention uses each unique pattern to distinguish between a plurality of golf clubs and a plurality of golf balls.

Preferably, the present invention is able to distinguish between each unique marker pattern. In one example of the present invention, each pattern may be distinguished using a mathematical algorithm. It is desired that the algorithm can detect the placement of the markers. Based on the marker placement, the algorithm can then plot the placement of each marker, and determine a mathematical relationship between them. The mathematical relationship between the markers may then be stored for each of the plurality of golf clubs and balls.

The swing speed of a club, and thus the velocity of the ball, may vary based on the skill or experience of a player, or the type of club being used. Swing speeds may vary between 30 and 150 mph, and ball speeds may vary between 30 and 225 mph. In order to extract useful information about the club and ball, such as that described above, the mathematical algorithm should be able to identify and match a pattern rapidly from a large list of stored patterns. It is desired that the time period for identification be about one second or less.

This time period preferably includes the total amount of time between receiving light reflected from the markers and the identification of the type of club or ball. This may include the time between detecting the placement of the markers, determining the mathematical relationship between the markers, and identifying the type of club or ball. However, steps may be included or excluded, depending on the type of mathematical algorithm that is used. Preferably, the present invention takes about six seconds or less to identify a pattern. More preferably, the present invention takes about one second or less to identify a pattern.

One example of the present invention is the use of a spatial Eigen value algorithm. Skilled artisans will recognize that eigen values and eigen vectors are commonly used for pattern matching applications. The present invention assigns an eigen value to each unique pattern. Then, the eigen value of a club in the field of view is determined. This eigen value is then matched to the stored eigen values. When two objects have substantially similar eigen values, the present invention is able to identify a club and its associated characteristics.

Another example of the present invention is the use of a least square spatial error matching algorithm. The least square error matching algorithm is well known to those skilled in the art. As applied to the present invention, the least square error matching method assumes that the closest matching pattern is a pattern that has the minimal sum of deviations squared, from a given set of data.

In a preferred embodiment, the present invention comprises placing a plurality of markers on the surface of a golf club and golf ball, as described above. The markers may be ink based or pad printable, though other markers known to those skilled in the art may be used. The plurality of markers placed on each golf club and golf ball are preferably arranged such that they form a unique pattern that is visible to the performance monitor when it is placed within the field of view. In another preferred embodiment, no markers are applied, and features inherent in the objects are used by the pattern recognition algorithm.

Preferably, the pattern of each of the plurality of golf clubs is then stored into a memory. In a preferred embodiment, this includes placing the club in the field of view of the performance monitor, acquiring an image of the object, and storing the object image or a data set which represents image features. In one example of the present invention, the club is preferably motionless when the pattern is being stored into the memory. However, in some embodiments, the golf club may be in motion when the pattern is being stored.

The pattern of markers on each golf ball likewise is stored into the memory. In a preferred embodiment, this includes placing the ball in the field of view of the performance monitor, acquiring an image of the object, and storing the object image or a data set which represents image features. Preferably, the ball is placed on a golf tee, or is resting motionless on a surface. However, in other embodiments, the golf ball may be in motion.

In a preferred embodiment, information describing the ball or club is manually entered into the computational device at substantially the same time that each pattern is stored into the memory. This information includes, but is not limited to, the manufacturer, head model, shaft model, shaft stiffness, head loft, club type, shaft length, grip model, ball model, or the like. After this point, no more additional information about the clubs and balls needs to be manually entered.

After the patterns of each ball and club are stored in the memory, a player may choose any combination of club and ball. Many performance monitors require a player to stand within a target area, or field of view. The field of view is typically in front of the performance monitor, at a predetermined distance. While standing in the field of view, a player may swing the golf club in order to have the kinematic characteristics of the swing and resultant ball trajectory analyzed.

In one example of the present invention, the image of the club is automatically acquired on the upswing or downswing of the club. Preferably, the club image is then compared to the previously stored club patterns, based on a numerical algorithm, as described above. The type of club may be determined by matching the received pattern with a stored pattern. The club type is determined automatically, without any manual input by an operator of the performance monitor.

In a similar manner, the type of golf ball may be determined. The ball marker pattern may be acquired when the ball is stationary, or while it is in motion. The ball image is then compared to the previously stored ball patterns, based on a numerical algorithm. The type of ball that is being used may then be determined by matching the received pattern with a stored pattern. Similar to the golf club, the type of golf ball is determined automatically, without any manual input by an operator of the performance monitor.

Using the identified club and ball, a performance monitor may correlate this information with the measured kinematic characteristics. A computational device, together with a memory, may store this information. This may be repeated for any ball and club combination. The performance monitor may then analyze a players performance with each type of club and ball to determine which equipment would best suit the player's swing. Skilled artisans will recognize that knowledge of the club and ball type, along with their kinematic characteristics, can be used to optimize a player's performance.

Although the present invention has been described with reference to particular embodiments, it will be understood to those skilled in the art that the invention is capable of a variety of alternative embodiments within the spirit of the appended claims.

The invention claimed is:

1. A method for identifying the type of golf club or golf ball, comprising:

storing image reference information for a plurality of golf clubs and golf balls to provide a library of stored patterns, wherein each of the stored patterns is assigned a Eigen value;

acquiring an image of at least one of said balls and clubs during a swing with at least one camera system to provide a received pattern;

assigning an Eigen value to the received pattern;

matching the received pattern with a stored pattern; and using a computational device and the assigned Eigen values to identify at least one of said club or ball.

2. The method according to claim 1, wherein the step of matching takes about six seconds or less.

3. The method according to claim 1, wherein the step of matching takes about one second or less.

4. The method according to claim 1, wherein said image reference information is based on a plurality of markers, wherein said markers comprise visible ink.

5. The method according to claim 4, wherein said markers comprise ink responsive to ultraviolet light.

6. The method according to claim 4, wherein said visible ink markers comprise limited spectrum markers responsive to one of colored light and fluorescent light.

7. The method according to claim 1, wherein said image reference information is based on inherent features of said balls and clubs.

8. The method of claim 1, wherein the each of the stored patterns has a unique Eigen value.

9. The method of claim 1, wherein the image reference patterns comprise at least one of manufacturer information, club head model, club shaft model, club shaft stiffness, club head loft, club shaft length, club grip model, or ball model.

10. A method for identifying the type of a plurality of golf clubs and golf balls, comprising:

storing image reference patterns based on a plurality of markers for each type of the plurality of golf clubs and golf balls;

assigning each reference pattern an Eigen value;

acquiring an image of at least one of said balls and clubs during a swing using at least one camera system to provide a received pattern; and identifying with a computational device the type of at least one of said club or ball based on a comparison of the received pattern to said image reference patterns in about six seconds or less using Eigen values.

11. The method according to claim 10, wherein said plurality of markers comprise visible ink.

12. The method according to claim 11, wherein said markers comprise ink responsive to ultraviolet light.

13. The method according to claim 11, wherein said visible ink markers comprise limited spectrum markers responsive to one of colored light and fluorescent light.

14. The method according to claim 10, wherein said image reference patterns are based on inherent features of said balls and clubs.

15. The method of claim 10, wherein the step of acquiring comprises receiving a pattern formed from placement of fluorescent markers on the surface of the golf club or golf ball.

16. The method of claim 10, wherein the type of golf club or golf ball is based on at least one of manufacturer, head model, shaft model shaft stiffness, head loft, shaft length, grip model, and ball model.

17. A system for identifying the type of golf club and golf ball, comprising:

at least one camera system; and a computational device capable of comparing an acquired image to a library of stored reference patterns with assigned Eigen values and identifying at least one of the type of golf club and golf ball, wherein the type of golf club is determined by comparison of at least one parameter selected from the group consisting from manufacturer, head model, shaft model shaft stiffness, head loft, shaft length, and grip model to the library of stored reference patterns and assigned Eigen values, and wherein the type of golf ball is determined by comparison of the ball model to the library of stored patterns and assigned Eigen values.

18. The system according to claim 17, wherein the library of stored reference patterns comprise club manufacturer, club head model, club shaft model, club shaft stiffness, club head loft, club shaft length, club grip model, and ball model for a plurality of golf clubs and golf balls.

19. The system according to claim 17, wherein the acquired image comprises a pattern based on a plurality of UV markers.

20. The system according to claim 17, wherein the acquired image comprises a pattern based on a plurality of visible markers.

21. The system according to claim 17, wherein said library of stored reference information comprises about 200 or more objects, each assigned a unique Eigen value.

* * * * *